US005707338A

United States Patent [19]

Adams et al.

[11] Patent Number: 5,707,338

[45] Date of Patent: Jan. 13, 1998

[54] STAPES VIBRATOR

[75] Inventors: Theodore P. Adams, Edina; Bruce A. Brillhart, Stillwater; Kai Kroll, Minnetonka; Donald J. Bushek, Plymouth, all of Minn.

[73] Assignee: St. Croix Medical, Inc., Minneapolis, Minn.

[21] Appl. No.: 693,411

[22] Filed: Aug. 7, 1996

[51] Int. Cl.[6] ..... H04R 25/00

[52] U.S. Cl. ..... 600/25

[58] Field of Search ..... 600/25; 607/55–57, 607/136, 137; 381/68, 69.2; 128/899; 601/46

[56] References Cited

U.S. PATENT DOCUMENTS

| | | | |
|---|---|---|---|
| 3,557,775 | 1/1971 | Mahoney . | |
| 3,764,748 | 10/1973 | Branch et al. . | |
| 3,931,648 | 1/1976 | Shea . | |
| 4,729,366 | 3/1988 | Schaefer et al. . | |
| 4,774,933 | 10/1988 | Hough et al. | 600/25 |
| 4,776,322 | 10/1988 | Hough et al. . | |
| 4,817,607 | 4/1989 | Tatge . | |
| 4,850,962 | 7/1989 | Schaefer | 600/25 |
| 4,957,478 | 9/1990 | Maniglia | 600/25 |
| 5,012,520 | 4/1991 | Steeger | 381/68 |
| 5,015,224 | 5/1991 | Maniglia | 600/25 |
| 5,015,225 | 5/1991 | Hough et al. | 600/25 |
| 5,277,694 | 1/1994 | Leysieffer et al. | 600/25 |
| 5,282,858 | 2/1994 | Bisch et al. | 623/10 |
| 5,338,287 | 8/1994 | Miller et al. | 600/25 |
| 5,360,388 | 11/1994 | Spindel et al. | 600/25 |
| 5,411,467 | 5/1995 | Hortmann et al. | 600/25 |
| 5,456,654 | 10/1995 | Ball | 600/25 |
| 5,498,226 | 3/1996 | Lenkauskas | 600/25 |
| 5,554,096 | 9/1996 | Ball | 600/25 |

OTHER PUBLICATIONS

"Middle Ear Implant: Implantable Hearing Aids", *Advances in Audiology*, vol. 4, M. Hoke Series Editor, Karger, 1–169, (1988).

T. Dumon, et al., "Piezoelectric Middle Ear Implant: Experimental Results", *Abstract of Paper Presented at International Symposium on Electronic Implants in Otology and Conventional Hearing Aids*, Walt Disney World Swan, Abstract #35, (Nov. 11–14, 1996).

J. M. Frederickson, et al., "Ongoing Investigations into an Implantable Electromagnetic Hearing Aid for Moderate to Severe Sensorineural Hearing Loss", *Otolaryngological Clinics of North America*, vol. 28, No. 1, 107–121, (Feb. 1995).

K. Gyo, et al., "Sound Pickup Utilizing an Implatable Piezpelectric Ceramic Bimorph Element: Application to the Cochlear Implant", *American Journal of Otology*, vol. 5, No. 4, 273–276, (Apr. 1984).

K. Gyo, et al., "Stapes Vibration Produced by the Output Transducer of an Implatable Hearing Aid", Arch Otolaryngol Head Neck Surg., vol. 113, 1078–1081, (Oct. 1987).

G. Jako, "Biomedical Engineering in Ear Surgery", *Otolaryngological Clinics of North America*, vol. 5, No. 1, 173–182, (Feb. 1972).

Wen H. Ko, et al., "Engineering Principles of Mechanical Stimulation of the Middle Ear", *Otolaryngological Clinics of North America*, vol. 28, No. 1, 29–41 (Feb. 1995).

(List continued on next page.)

*Primary Examiner*—Jennifer Bahr
*Assistant Examiner*—Samuel Gilbert
*Attorney, Agent, or Firm*—Schwegman, Lundberg, Woessner & Kluth, P.A.

[57] ABSTRACT

A method and apparatus for vibrating an auditory element, such as a stapes, within an ear to improve hearing. A piezoelectric transducer is interposed within an inner circumference of the stapes, such as between the neck and footplate. An electrical input signal is applied to the transducer to vibrate an oval window or perilymph of the cochlea, either directly or through the stapes. The vibrator has small size and low power consumption, which are particularly advantageous for partial middle ear implantable (P-MEI) or total middle ear implantable (T-MEI) hearing aid systems.

54 Claims, 11 Drawing Sheets

OTHER PUBLICATIONS

K. Kodera, et al., "Sound Evaluation of Partially Implantable Pewzoelectric Middle Ear Implant: Comparative Study of Frequency Responses", *ENT. Journal*, vol. 73, No. 2, 108–111, (Feb. 1994).

A. J. Maniglia, et al., "A Contactless Electromagnetic Implantable Middle Ear Device for Sensorineural Hearing Loss", *ENT Journal*, vol. 73, No. 2, 78–90, (Feb. 1994).

A. J. Maniglia, et al., "Contactless, Semi–Implantable Electromagnetic Hearing Device for the Treatment of Sensorineural Hearing Loss", *Abstract of Paper Presented at International Symposium on Electronic Implants in Otology and Conventional Hearing Aids*, Walt Disney World Swan, Abstract #29, (Nov. 11–14, 1993).

Jun–Ichi Suzuki, et al., "Long–Term Clinical Results of the Partially Implantable Piezoelectric Middle Ear Implant", *ENT Journal*, vol. 73, No. 2, 104–107 (Feb. 1994).

M. Tos, et al., "Implantation of Electromagnetic Ossicular Replacement Device", *ENT Journal*, vol. 73, No. 2, 93–103, (Feb. 1994).

D. B. Welling, et al., "Auditory Stimulation of the Inner Ear via the Semicircular Canals", *Abstract of paper presented at International Symposium on Electronic Implants in Otology and Conventional Hearing Aids*, Walt Disney World Swan, Abstract #9, (Nov. 11–14, 1993).

N. Yanagihara, et al., "Partially Implantable Hearing Aid using Piezoelectric Ceramic Ossicular Vibrator", *Abstract of Paper Presented at International Symposium on Electronic Implants in Otology and Conventional Hearing Aids*, Walt Disney World Swan, Abstract #26, (Nov. 11–14, 1993).

STAPES VIBRATOR

FIELD OF THE INVENTION

This invention relates to an electromechanical transducer for use in a hearing system implantable in a middle ear.

BACKGROUND

In some types of partial middle ear implantable (P-MEI) or total middle ear implantable (T-MEI) hearing aid systems, sounds transduced into electrical signals are amplified and applied to an electromechanical output transducer, which in turn vibrates an ossicular bone in response to the applied amplified electrical signals to improve hearing.

Such an electromechanical output transducer should be proportioned to provide convenient implantation in the middle ear. Low power consumption transducers are also desired, particularly for the T-MEI hearing aid system, which uses a limited longevity implanted battery as a power source.

SUMMARY OF THE INVENTION

The invention provides a method and apparatus for vibrating a stapes in response to an electrical input signal. A vibrator comprises an electromechanical transducer which vibrates an auditory element in response to an electrical input signal. The transducer is interposed between a first and a second portion of the stapes.

In one embodiment, the vibrated auditory element is the stapes, which in turn vibrates an oval window of a cochlea. In another embodiment, the oval window of the cochlea is vibrated directly. In one embodiment, the first and second portion of the stapes between which the transducer is interposed comprise a footplate and a neck portion of the stapes respectively. In another embodiment, the first and second portion of the stapes between which the transducer is interposed comprise first and second crura portions of the stapes respectively.

The transducer dynamically varies at least one of its physical dimensions in response to the electrical input signal. In one embodiment, the dynamically varying physical dimension of the transducer is its length in a longitudinal direction between the first and second portions of the stapes. In response to the dynamically varying transducer length, the stapes mechanically couples a force to the oval window of the cochlea. In one optional embodiment, the vibrator further comprises at least one spacer proportioned to improve the fit of the transducer between the first and second portions of the stapes.

In another embodiment, a bi-element transducer is interposed between first and second portions of the stapes comprising first and second crura respectively. The bi-element transducer vibrates in response to an electrical input signal applied across its first and second plates. The vibration is coupled to an auditory element by a rod. In one embodiment, the vibrated auditory element is a footplate portion of the stapes, which in turn vibrates the oval window portion of the cochlea. In another embodiment, the oval window portion of the cochlea is directly vibrated by the rod which extends through a hole in the footplate of the stapes.

The vibrator is particularly advantageous when used in a middle ear implantable hearing system such as a partial middle ear implantable (P-MEI) or total middle ear implantable (T-MEI) hearing aid system. The vibrator has small size and low power consumption and need not be secured to a temporal bone within the middle ear.

BRIEF DESCRIPTION OF THE DRAWINGS

In the drawings, like numerals describe like components throughout the several views.

DETAILED DESCRIPTION

Figure 1:
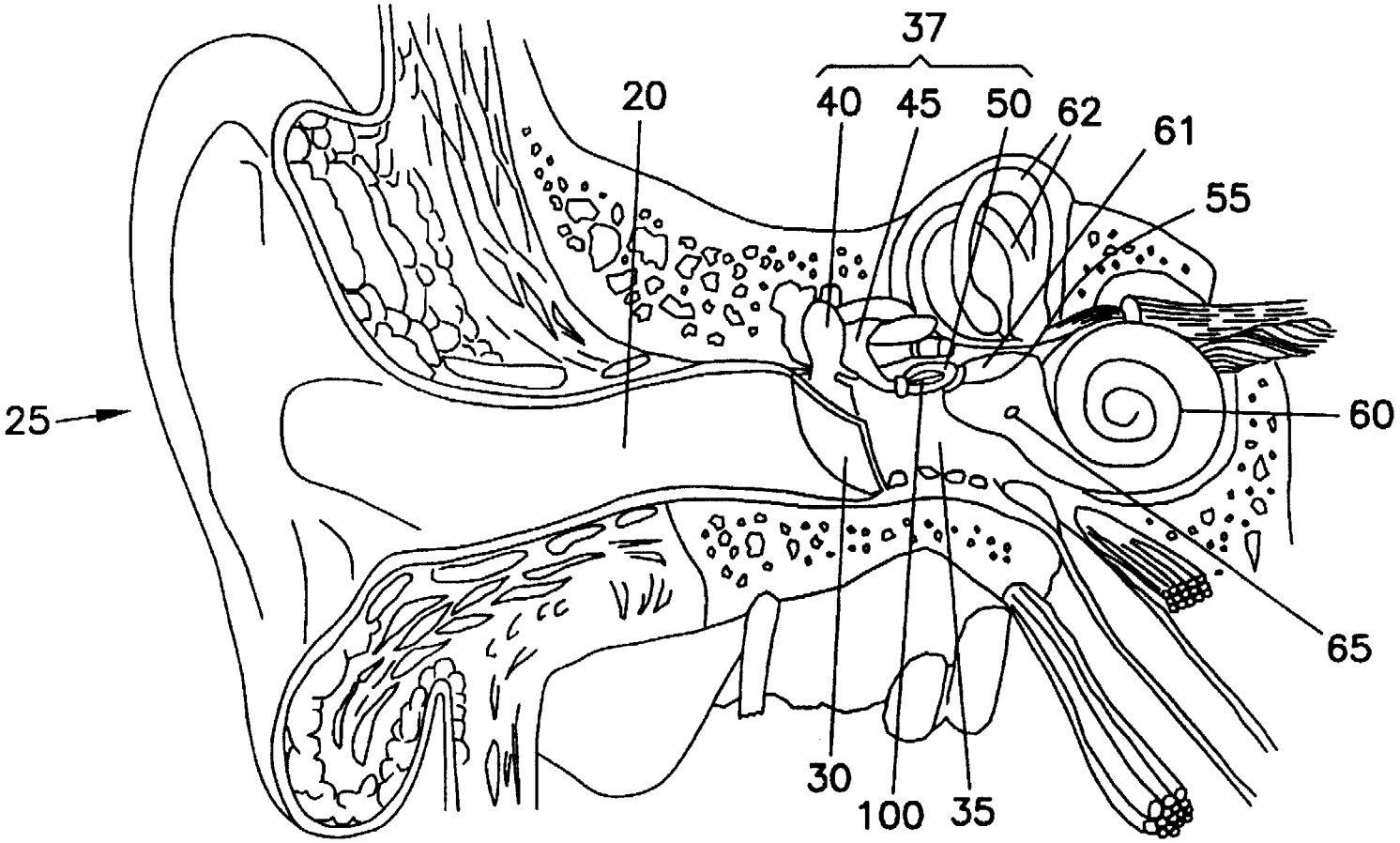
FIG. 1 illustrates a frontal section of an anatomically normal human right ear in which the invention operates.

The invention provides an electromechanical transducer which is particularly advantageous when used in a middle ear implantable hearing system such as a partial middle ear implantable (P-MEI) or total middle ear implantable (T-MEI) hearing aid system. A P-MEI or T-MEI hearing aid system assists the human auditory system in converting acoustic energy contained within sound waves into electrochemical signals delivered to the brain and interpreted as sound. FIG. 1 illustrates generally the use of the invention in a human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the tympanic membrane (eardrum) 30, interposed at the terminus of the external auditory canal 20, between it and the tympanic cavity (middle ear) 35. Variations in the sound waves produce tympanic vibrations. The mechanical energy of the tympanic vibrations is communicated to the inner ear, comprising cochlea 60, vestibule 61, and semicircular canals 62, by a sequence of articulating bones located in the middle ear 35. This sequence of articulating bones is referred to generally as the ossicular chain 37. Thus, the tympanic membrane 30 and ossicular chain 37 transform acoustic energy in the external auditory canal 20 to mechanical energy at the cochlea 60.

The ossicular chain 37 includes three primary components: a malleus 40, an incus 45, and a stapes 50. The malleus 40 includes manubrium and head portions. The manubrium of the malleus 40 attaches to the tympanic membrane 30. The head of the malleus 40 articulates with one end of the incus 45. The incus 45 normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus 45 articulates the capitulum of the stapes 50 to complete the mechanical transmission path.

Normally, prior to implantation of the invention, tympanic vibrations are mechanically conducted through the malleus 40, incus 45, and stapes 50, to the oval window 55. Vibrations at the oval window 55 are conducted into the fluid-filled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain 37, and/or cochlea 60 can disrupt or impair normal hearing.

Hearing loss due to damage in the cochlea is referred to as sensorineural hearing loss. Hearing loss due to an inability to conduct mechanical vibrations through the middle ear is referred to as conductive hearing loss. Some patients have an ossicular chain 37 lacking sufficient resiliency to transmit mechanical vibrations between the tympanic membrane 30 and the oval window 55. As a result, fluidic motion in the cochlea 60 is attenuated. Thus, receptor cells in the cochlea 60 do not receive adequate mechanical stimulation. Damaged elements of ossicular chain 37 may also interrupt transmission of mechanical vibrations between the tympanic membrane 30 and the oval window 55.

Various techniques have been developed to remedy hearing loss resulting from conductive or sensorineural hearing disorder. For example, tympanoplasty is used to surgically reconstruct the tympanic membrane 30 and establish ossicular continuity from the tympanic membrane 30 to the oval window 55. Various passive mechanical prostheses and implantation techniques have been developed in connection with reconstructive surgery of the middle ear 35 for patients with damaged elements of ossicular chain 37. Two basic forms of prosthesis are available: total ossicular replacement prostheses (TORP), which is connected between the tympanic membrane 30 and the oval window 55; and partial ossicular replacement prostheses (PORP), which is positioned between the tympanic membrane 30 and the stapes 50.

Various types of hearing aids have been developed to compensate for hearing disorders. A conventional "air conduction" hearing aid is sometimes used to overcome hearing loss due to sensorineural cochlear damage or mild conductive impediments to the ossicular chain 37. Conventional hearing aids utilize a microphone, which transduces sound into an electrical signal. Amplification circuitry amplifies the electrical signal. A speaker transduces the amplified electrical signal into acoustic energy transmitted to the tympanic membrane 30. However, some of the transmitted acoustic energy is typically detected by the microphone, resulting in a feedback signal which degrades sound quality. Conventional hearing aids also often suffer from a significant amount of signal distortion.

Implantable hearing aid systems have also been developed, utilizing various approaches to compensate for hearing disorders. For example, cochlear implant techniques implement an inner ear hearing aid system. Cochlear implants electrically stimulate auditory nerve fibers within the cochlea 60. A typical cochlear implant system includes an external microphone, an external signal processor, and an external transmitter, as well as an implanted receiver and an implanted single channel or multichannel probe. A single channel probe has one electrode. A multichannel probe has an array of several electrodes. In the more advanced multichannel cochlear implant, a signal processor converts speech signals transduced by the microphone into a series of sequential electrical pulses corresponding to different frequency bands within a speech frequency spectrum. Electrical pulses corresponding to low frequency sounds are delivered to electrodes that are more apical in the cochlea 60. Electrical pulses corresponding to high frequency sounds are delivered to electrodes that are more basal in the cochlea 60. The nerve fibers stimulated by the electrodes of the cochlear implant probe transmit neural impulses to the brain, where these neural impulses are interpreted as sound.

Other inner ear hearing aid systems have been developed to aid patients without an intact tympanic membrane 30, upon which "air conduction" hearing aids depend. For example, temporal bone conduction hearing aid systems produce mechanical vibrations that are coupled to the cochlea 60 via a temporal bone in the skull. In such temporal bone conduction hearing aid systems, a vibrating element can be implemented percutaneously or subcutaneously.

A particularly interesting class of hearing aid systems includes those which are configured for disposition principally within the middle ear 35 space. In middle ear implantable (MEI) hearing aids, an electrical-to-mechanical output transducer couples mechanical vibrations to the ossicular chain 37, which is optionally interrupted to allow coupling of the mechanical vibrations to the ossicular chain 37. Both electromagnetic and piezoelectric output transducers have been used to effect the mechanical vibrations upon the ossicular chain 37.

One example of a partial middle ear implantable (P-MEI) hearing aid system having an electromagnetic output transducer comprises: an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus 45. Such electromagnetic output transducers have relatively high power consumption, which limits their usefulness in total middle ear implantable (T-MEI) hearing aid systems.

A piezoelectric output transducer is also capable of effecting mechanical vibrations to the ossicular chain 37. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed. A resulting electrical signal is provided to an electrical-to-mechanical piezoelectric output transducer that generates a mechanical vibration coupled to an element of the ossicular chain 37 or to the oval window 55 or round window 65. In the '366 patent, the ossicular chain 37 is interrupted by removal of the incus 45. Removal of the incus 45 prevents the mechanical vibrations delivered by the piezoelectric output transducer from mechanically feeding back to the piezoelectric input transducer.

Piezoelectric output transducers have several advantages over electromagnetic output transducers. The smaller size or volume of the piezoelectric output transducer advantageously eases implantation into the middle ear 35. The lower power consumption of the piezoelectric output transducer is particularly attractive for T-MEI hearing aid systems, which include a limited longevity implanted battery as a power source.

A piezoelectric output transducer is typically implemented as a ceramic piezoelectric bi-element transducer, which is a cantilevered double plate ceramic element in which two plates are bonded together such that they amplify a piezoelectric action in a direction approximately normal to the bonding plane. Such a bi-element transducer vibrates according to a potential difference applied between two bonded plates. A proximal end of such a bi-element transducer is typically cantilevered from a transducer mount which is secured at a reference point to a temporal bone within the middle ear. A distal end of such a bi-element transducer couples mechanical vibrations to an ossicular element such as stapes 50. However, securing a bi-element transducer mount to the temporal bone adds invasive complexity to the surgical implantation procedure.

In FIG. 1, a vibrator 100 of one embodiment of the present invention is interposed within an inner circumference of stapes 50, between a first and a second portion of stapes 50, in such a manner that it need not be secured to a temporal bone within middle ear 35.

Figure 2:
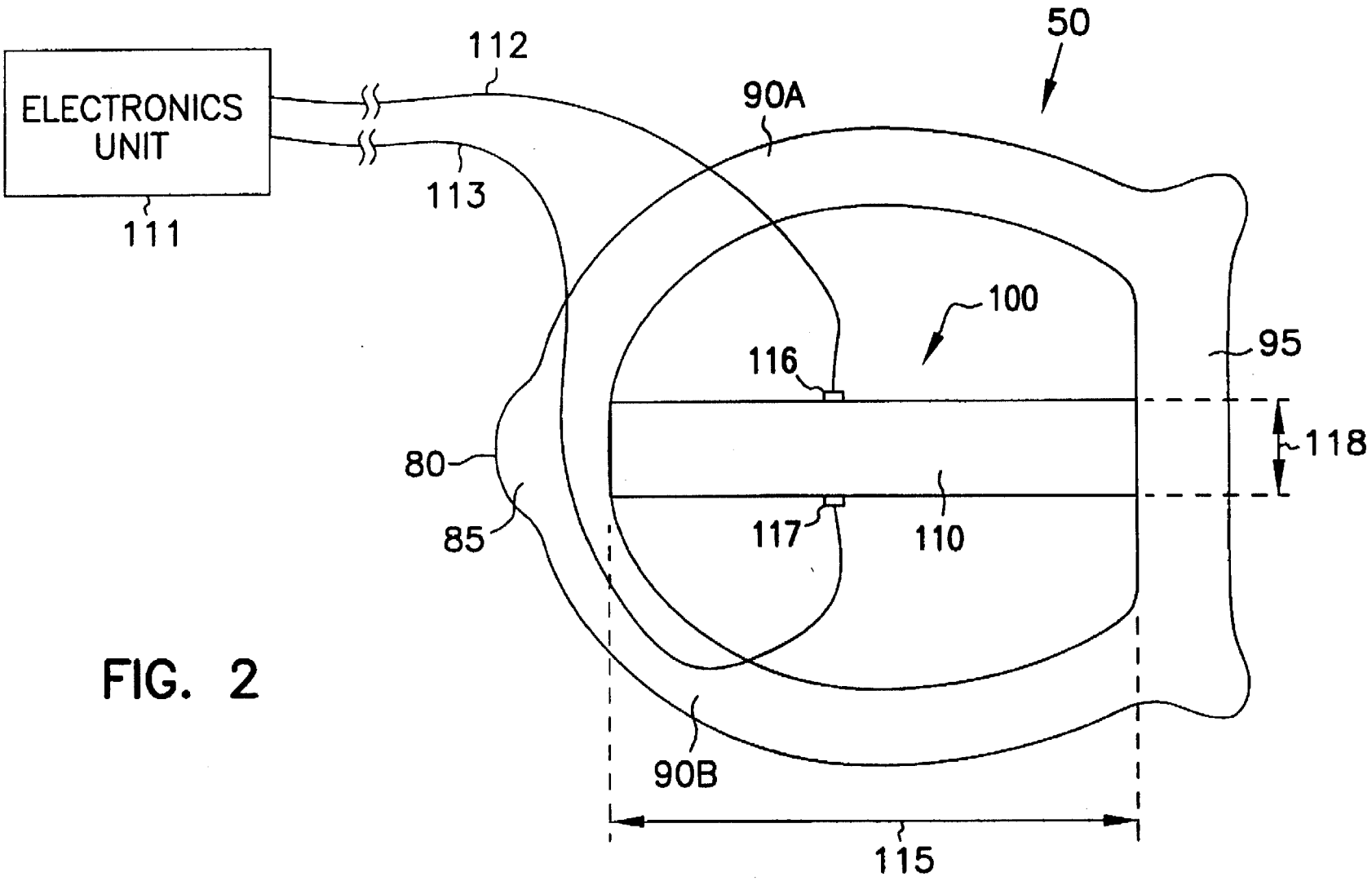
FIG. 2 illustrates a vibrator interposed within an inner circumference of the stapes between a neck portion and a footplate portion of the stapes.

FIG. 2 illustrates generally one embodiment of the invention showing stapes 50 in more detail. In FIG. 2, stapes 50 comprises head 80, neck 85, two crura 90A–B, and footplate 95 portions. Vibrator 100, comprising a ceramic piezoelectric transducer 110 proportioned for disposition within an inner circumference of the stapes 50, is interposed between first and second portions of the stapes 50. In one embodiment, first and second portions of the stapes comprise footplate 95 and neck 85 respectively. Transducer 110 is proportioned having a length 115 in a longitudinal direction between the footplate 95 and neck 85 portions of stapes 50. Length 115 is selected such that transducer 110 fits snugly between footplate 95 and neck 85 within the inner circumference of stapes 50. In one embodiment, transducer 110 comprises a single ceramic piezoelectric transducer.

In one embodiment, a proximal end of transducer 110 is mechanically coupled to an inner circumference of stapes 50 at neck 85, and a distal end of transducer 110 is mechanically coupled to an inner circumference of stapes 50 at footplate 95. In a preferred embodiment, at least one of respective distal and proximal ends of transducer 110 is shaped to conform to complementary surface(s) of stapes 50. Such shaping of transducer 110 may also be used to secure transducer 110 in place within the inner circumference of stapes 50 by improving the frictional fit at the contact surface. In another embodiment, at least one of respective distal and proximal ends of transducer 110 is affixed to one or both of footplate 95 and neck 85 portions of stapes 50, such as by a mechanical fastener, an adhesive, or any other attachment technique.

This embodiment uses a piezoelectric effect with displacement approximately orthogonal to the direction of an applied electrical input signal, although a piezoelectric effect in another direction may also be used at the designer's discretion by rearranging the connection points accordingly. In this embodiment, electronics unit 111 provides an electrical input signal through lead wires 112 and 113 at respective connection points 116 and 117 located across a thickness 118 of transducer 110, normal to its length 115, at any convenient points. Due to its piezoelectric nature, length 115 of transducer 110 increases and decreases in response to the applied electrical input signal. These variations in length 115 of transducer 110 deform stapes 50, thereby correspondingly varying the distance between footplate 95 and neck 85 portions of stapes 50 to cause mechanical vibration of stapes 50. As a result of this mechanical vibration, stapes 50 couples a corresponding force to cochlea 60 at oval window 55.

In one embodiment, any increases in length 115 outwardly deform stapes 50 between footplate 95 and neck 85 portions, and spring tension within stapes 50 returns footplate 95 and neck 85 toward their original positions when length 115 subsequently decreases. In one embodiment, in which transducer 110 is attached, by biocompatible adhesive, fastener, or other technique, at both its distal and proximal ends to respective footplate 95 and neck 85 portions of stapes 50, any increases in length 115 actively deform stapes 50 outwardly between footplate 95 and neck 85 portions, and subsequent decreases in length 115 actively pull stapes 50 inwardly between footplate 95 and neck 85 portions.

Figure 3:
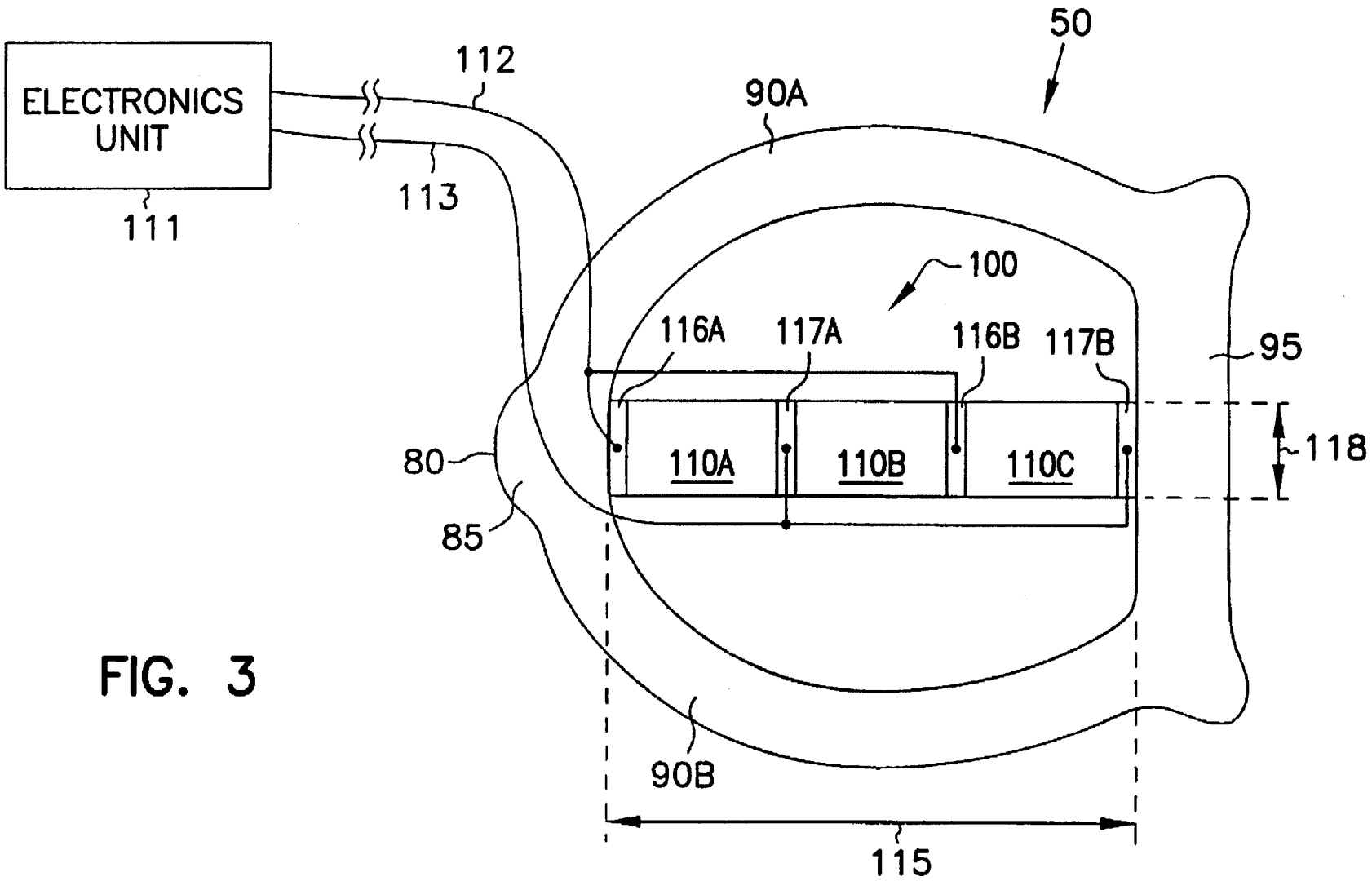
FIG. 3 illustrates a vibrator in which the transducer comprises a stack of piezoelectric elements.

FIG. 3 illustrates generally a further embodiment of the invention. In FIG. 3, vibrator 100 comprises a selectable number of stacked ceramic piezoelectric transducers, such as 100A–C, having a combined length 115. Transducers 100A–C are electrically wired in parallel for receiving an electrical input signal through lead wires 112 and 113 at respective connection points 116A–B and 117A–B, pairwise located across a length of each transducer 110A–C, in the direction of their combined length 115, at any convenient points.

This embodiment uses a piezoelectric effect with a displacement in the same direction as the applied electrical input signal, although a piezoelectric effect in another direction may also be used at the designer's discretion by rearranging the connection points accordingly. In this embodiment, in response to the received electrical input signal, the length of each transducer 100A–C varies, causing a relatively larger variation in combined length 115. The exact number of stacked ceramic piezoelectric transducers 100A–C is selected to meet a desired variation in combined length 115.

Figure 4B:
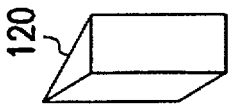
FIG. 4B illustrates the spacer of FIG. 4A in more detail.
Figure 4A:
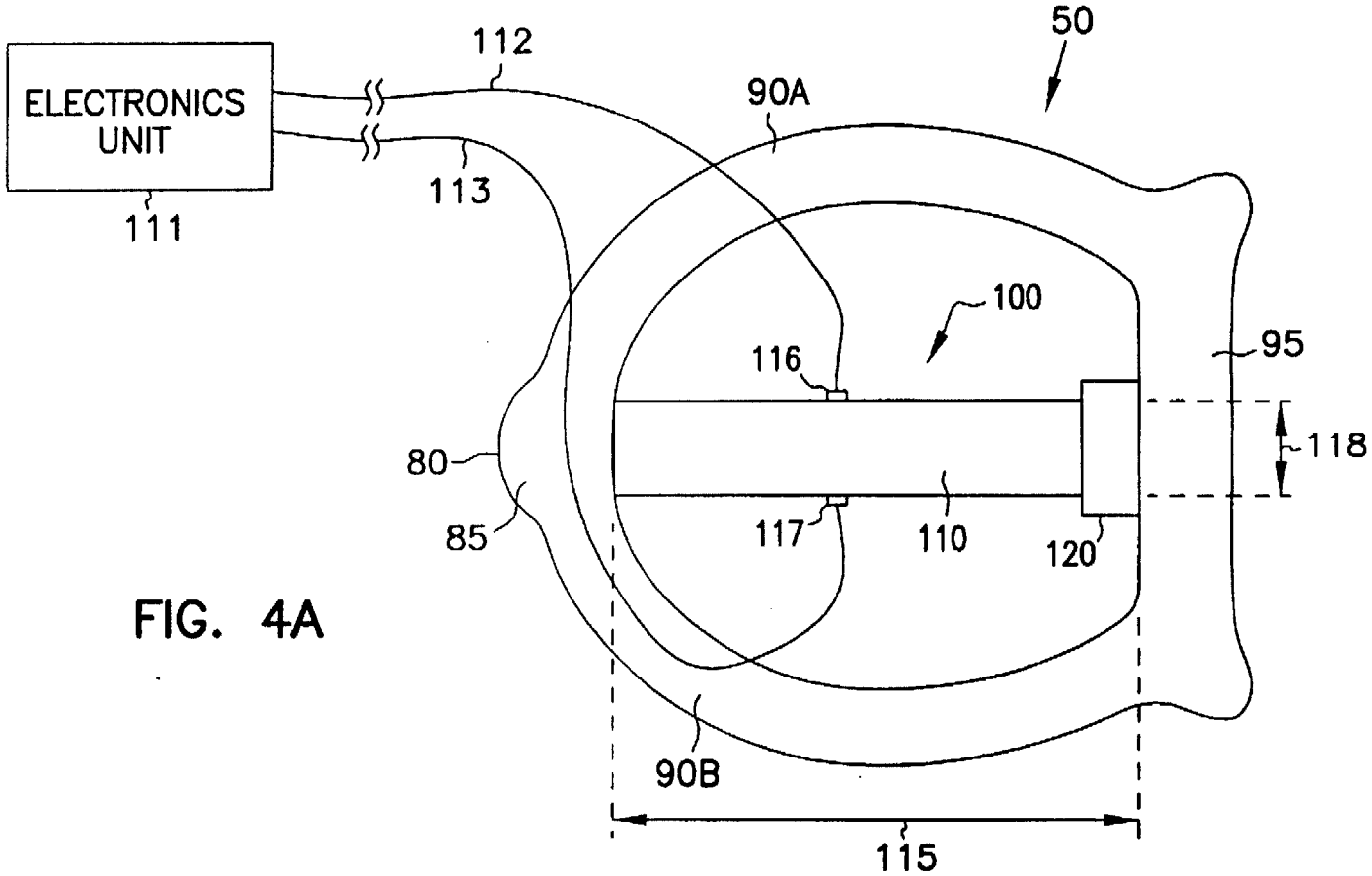
FIG. 4A illustrates a vibrator including a spacer at the footplate for fitting the vibrator within the inner circumference of the stapes.

FIG. 4A illustrates generally a further embodiment of the invention. In FIG. 4A, vibrator 100 comprises transducer 110 of length 115 and also comprises spacer 120 coupled to transducer 110 and stapes 50. Spacer 120 is a physical element which accommodates any difference between length 115 and the distance between footplate 95 and neck 85 portions of the inner circumference of stapes 50. Spacer 120 allows transducer 110 to fit snugly within the inner circumference of stapes 50. In one embodiment, spacer 120 comprises a wedge inserted between transducer 110 and footplate 95, as illustrated in FIG. 4B.

Figure 5:
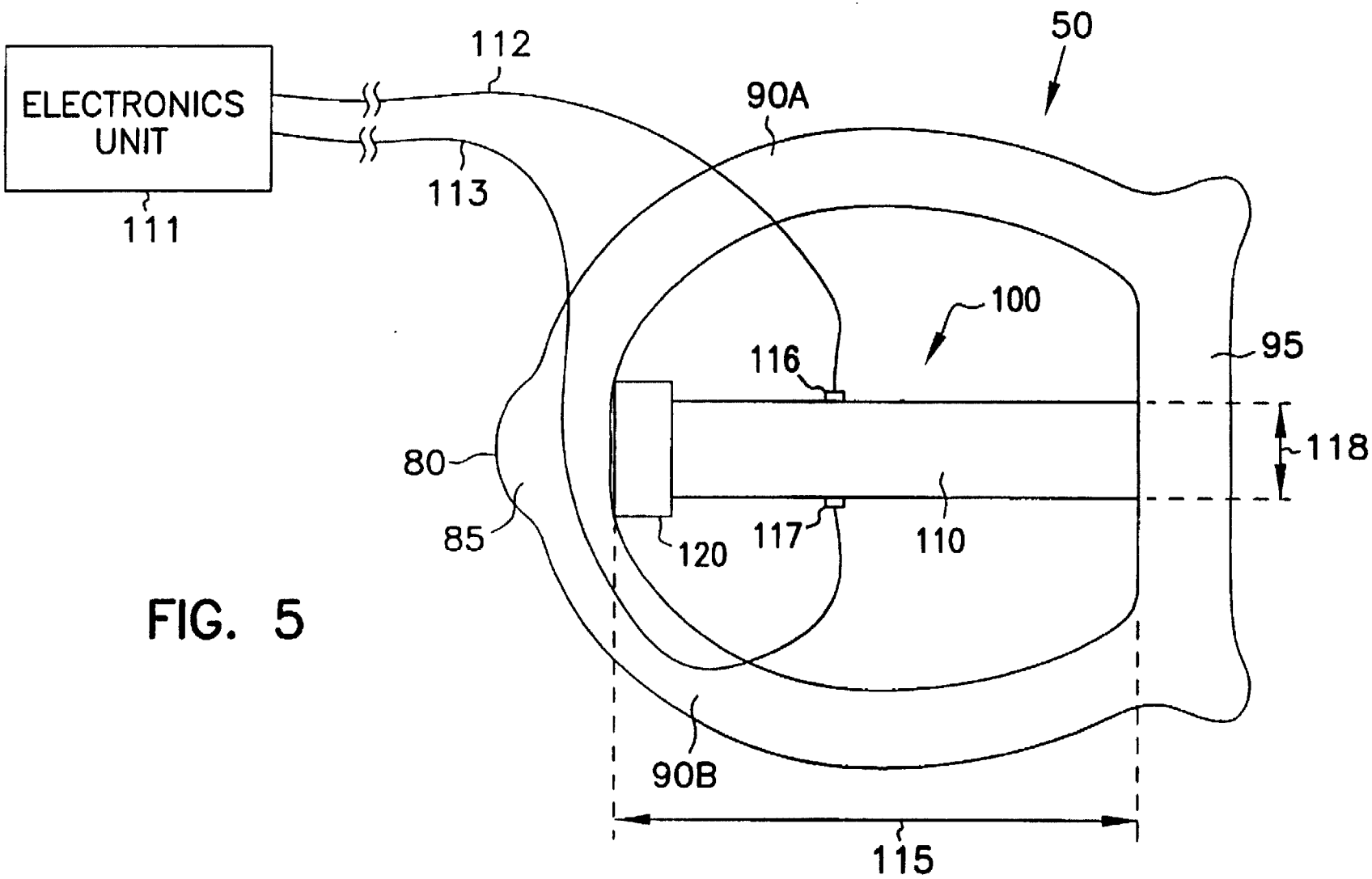
FIG. 5 illustrates a vibrator including a spacer at the neck for fitting the vibrator within the inner circumference of the stapes.

FIG. 5 illustrates generally another embodiment of the invention in which spacer 120 is inserted between transducer 110 and neck 85. Multiple spacers 120 could also be used, for example, a first spacer 120 could be inserted between transducer 110 and footplate 95 and a second spacer 120 could be inserted between transducer 110 and neck 85. In one embodiment, spacer 120 is adhesively attached in situ to transducer 110, stapes 50, or both. Spacer 120 could be inserted using any other technique which allows transducer 110 to fit snugly within the inner circumference of stapes 50.

Figure 6:
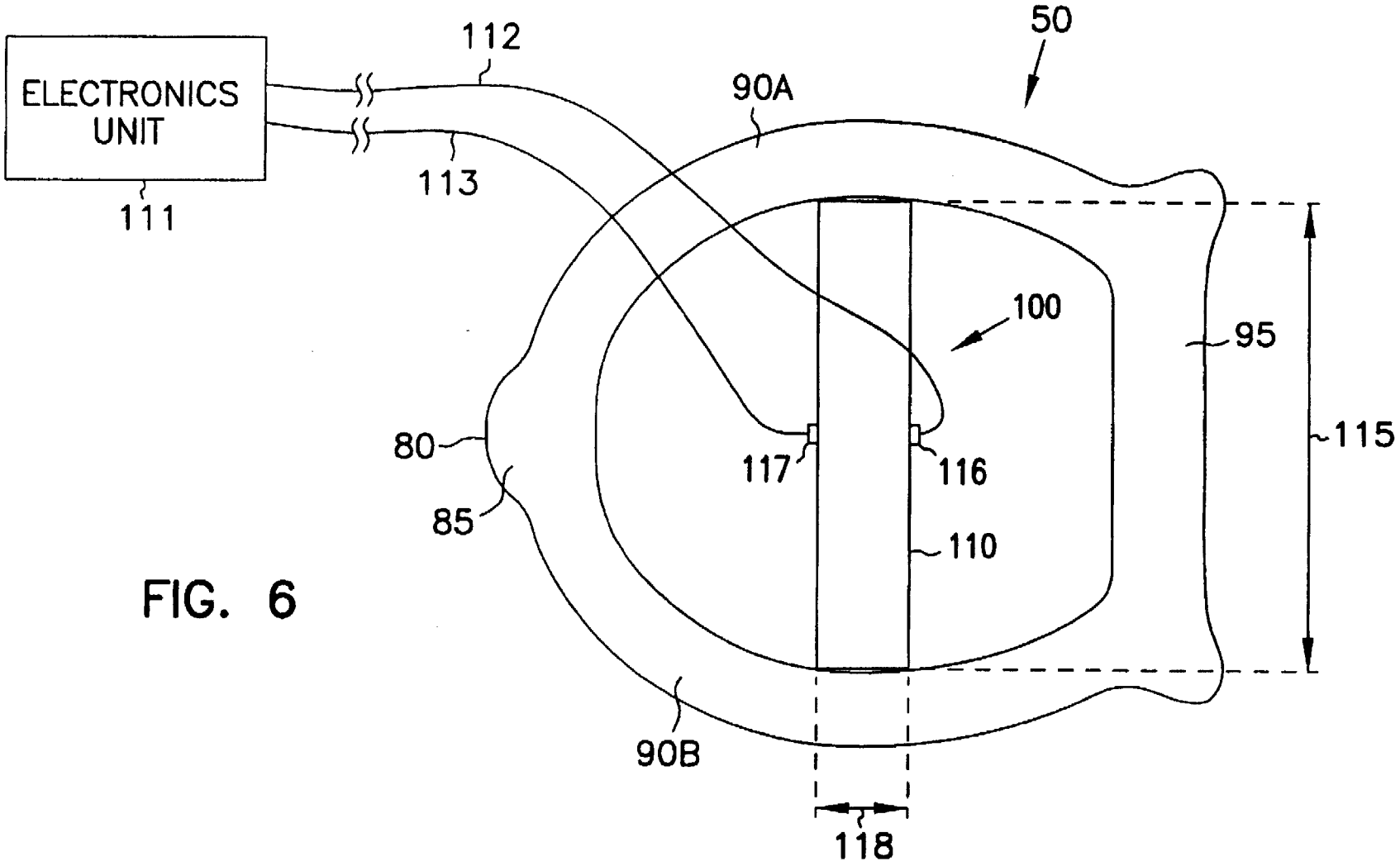
FIG. 6 illustrates a vibrator interposed within the inner circumference of the stapes between two crura portions of the stapes.

FIG. 6 illustrates generally another embodiment of the invention in which vibrator 100 is interposed within the inner circumference of stapes 50 between the two crura 90A–B. Electronics unit 111 provides an electrical input signal through lead wires 112 and 113 coupled to connection points 116 and 117 located across a thickness 118 of transducer 110, normal to its length 115, at any convenient points. This embodiment may result in reduced force at oval window 55 portion of cochlea 60. Vibrator 100 may also be otherwise interposed at other locations within the inner circumference of stapes 50.

Figure 7:
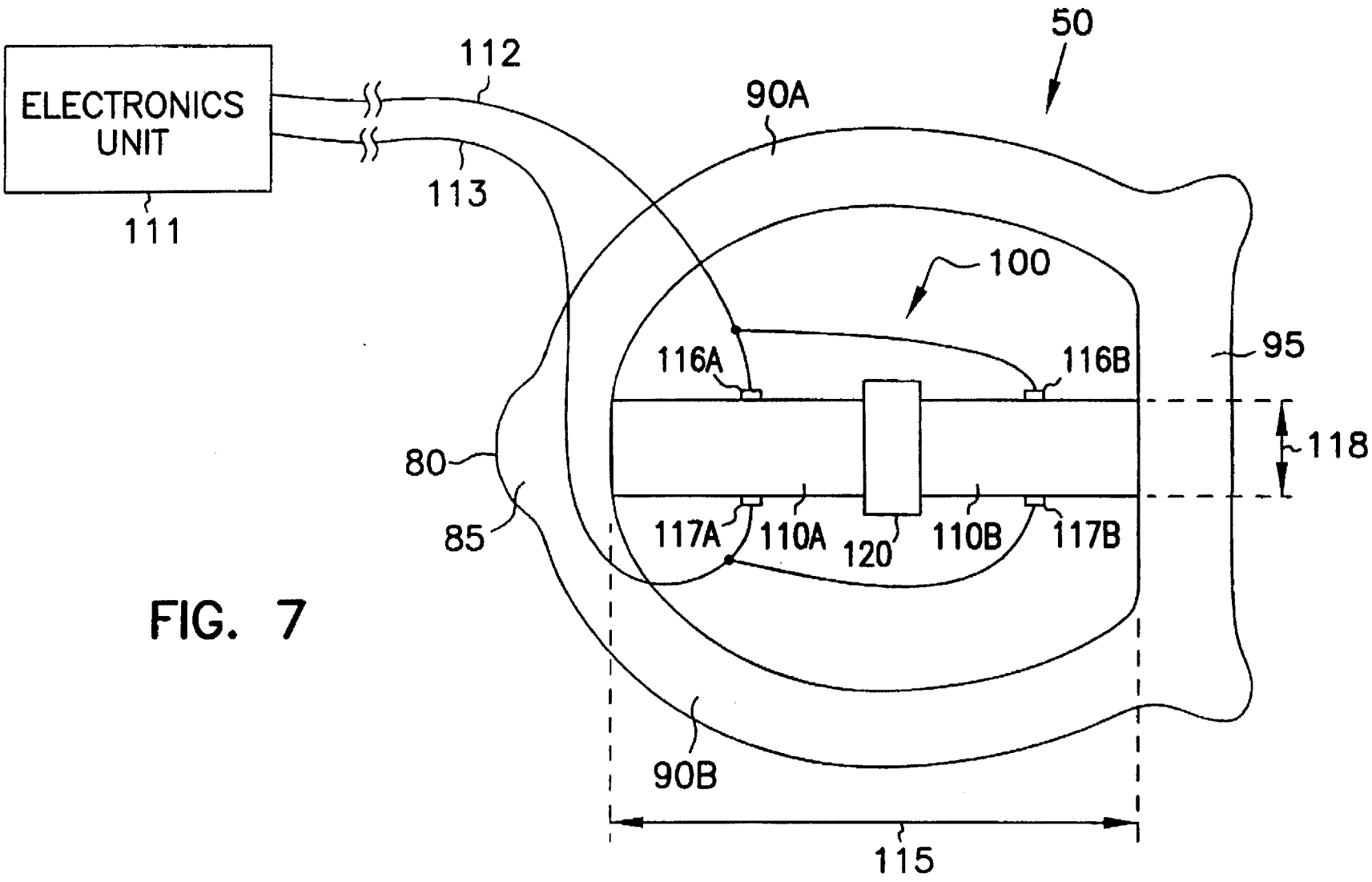
FIG. 7 illustrates a vibrator additionally including a spacer interposed between two transducer elements wired electrically in parallel.

FIG. 7 illustrates generally another embodiment of the invention in which spacer 120 is interposed within a stack of ceramic piezoelectric transducers 110A–B. This embodiment uses a piezoelectric effect with displacement approximately orthogonal to the direction of an applied electrical input signal, although a piezoelectric effect in another direction may also be used at the designer's discretion by rearranging the connection points accordingly. Electronics unit 111 provides an electrical input signal through lead wires 112 and 113 at respective connection points 116A–B and 117A–B, pairwise located across a thickness 118 of each transducer 110A–B, normal to their combined length 115, including that of spacer 120, at any convenient points. Transducers 110A–B are electrically configured in parallel and receive an electrical input signal of the same polarity, such that transducers 110A–B expand and contract in concert with each other.

Figure 8:
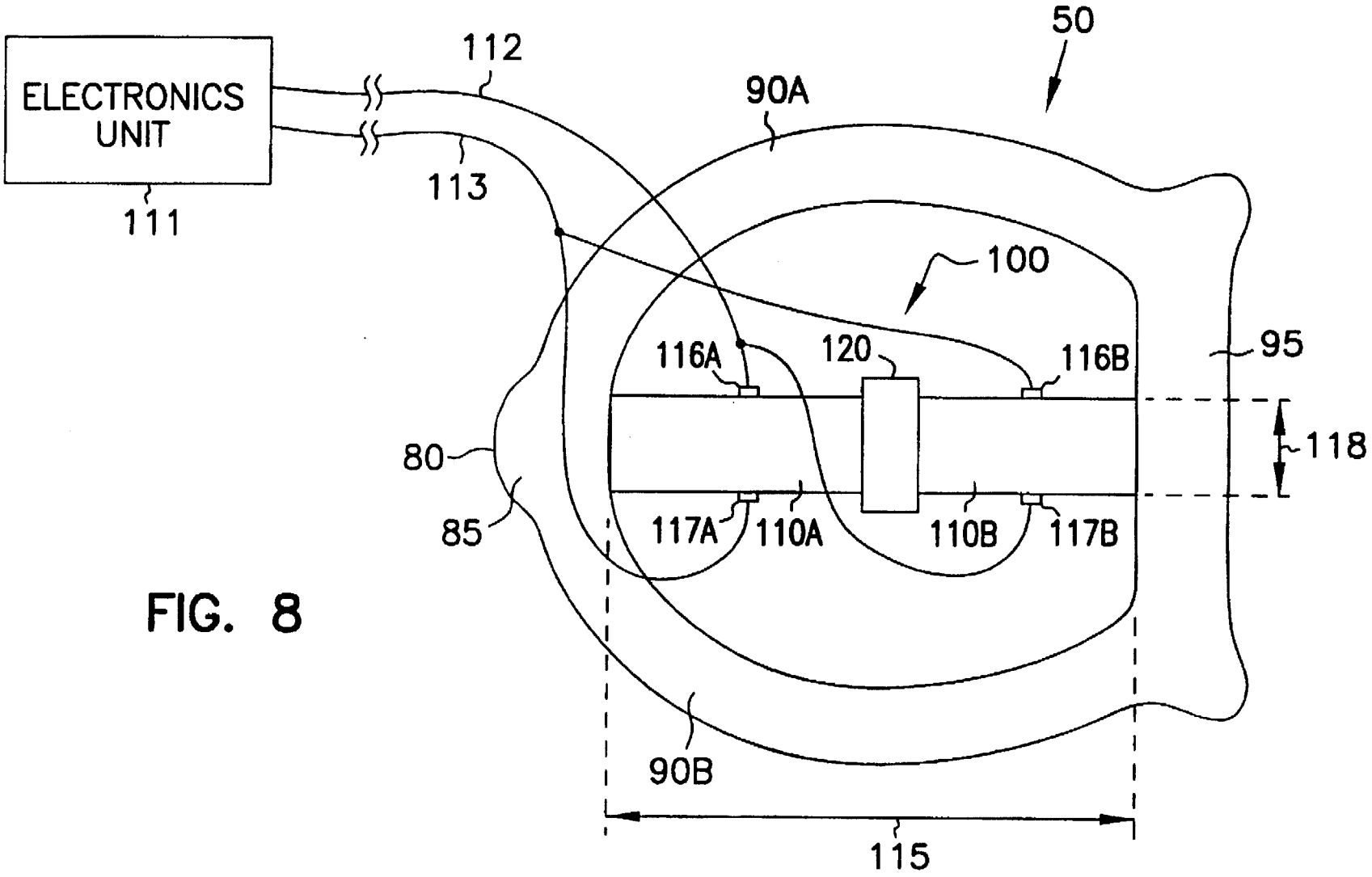
FIG. 8 illustrates a vibrator including a spacer interposed between two transducer elements wired electrically in anti-parallel.

FIG. 8 illustrates generally another embodiment of the invention in which spacer 120 is interposed within a stack of ceramic piezoelectric transducers 110A–B. In this embodiment, spacer 120 may also serve as an inertial mass, as described below. This embodiment uses a piezoelectric effect with displacement approximately orthogonal to the direction of an applied electrical input signal, although a piezoelectric effect in another direction may also be used at the designer's discretion by rearranging the connection points accordingly. Electronics unit 111 provides an electrical input signal through lead wires 112 and 113 at respective connection points 116A–B and 117A–B, pairwise located across a thickness 118 of each transducer 110A–B, normal to their combined length 115, including that of spacer 120, at any convenient points. Transducers 110A–B are electrically configured in anti-parallel; transducers 110A–B receive an electrical input signal of opposite polarity. Thus, transducer 110A expands while transducer 110B contracts, and transducer 110A contracts while transducer 110B expands. The inertial mass of spacer 120 resists these vibrations such that the vibrations are mechanically coupled to the stapes 50 through transducers 110A–B.

Figure 9B:
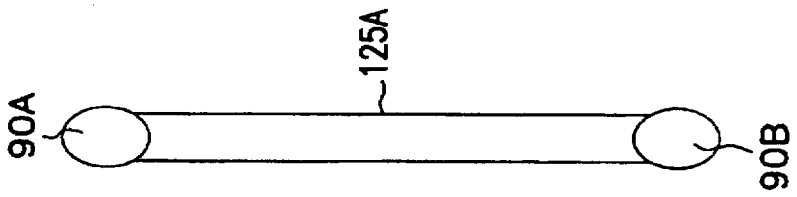
FIG. 9B illustrates a cross-sectional view of the vibrator of FIG. 9A.
Figure 9A:
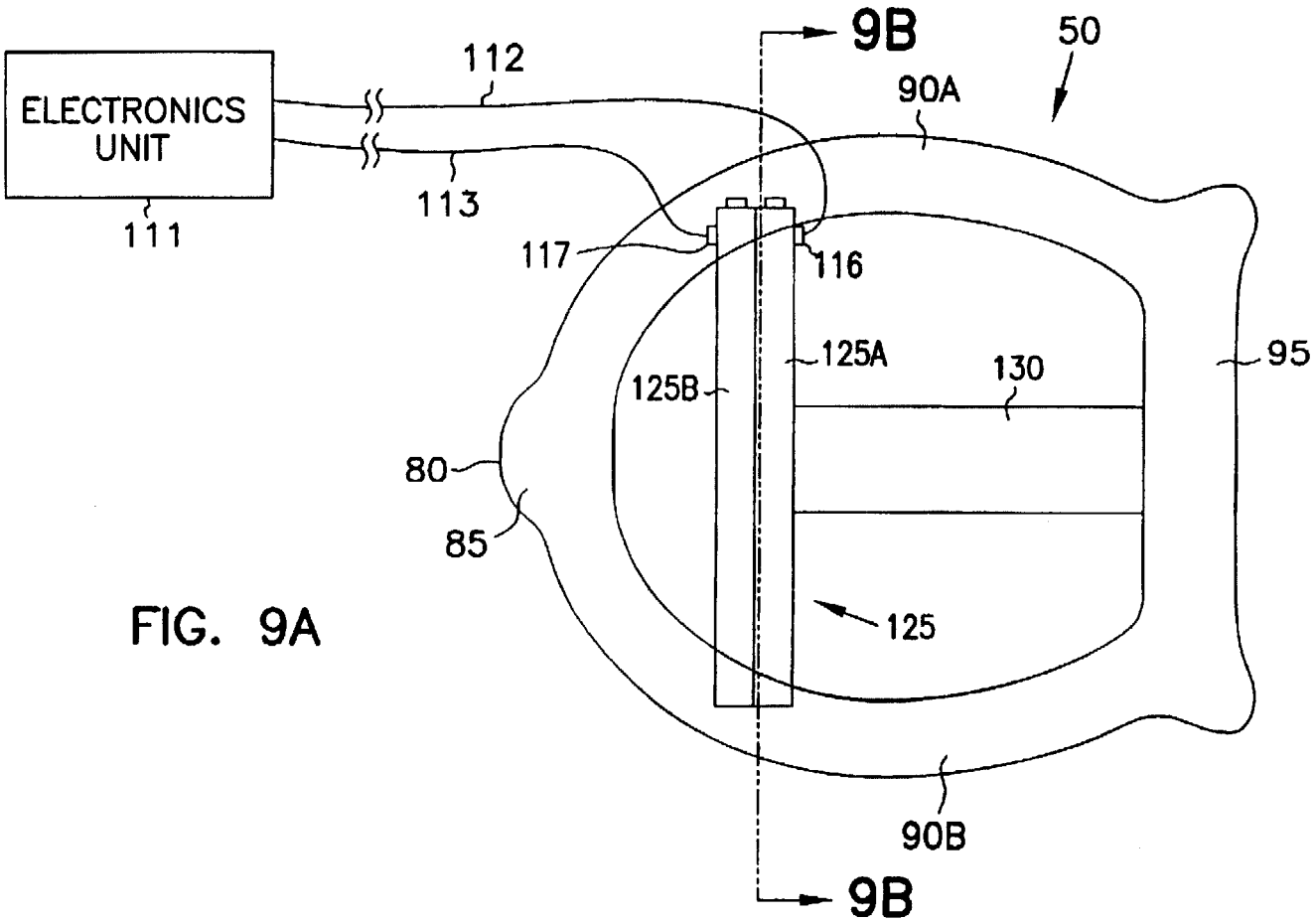
FIG. 9A illustrates a vibrator including a bi-element transducer and a rod interposed between the bi-element transducer and a footplate portion of the stapes.

FIG. 9A illustrates generally another embodiment of the invention using a ceramic piezoelectric bi-element transducer 125, interposed between first and second portions of stapes 50. More particularly, bi-element transducer 125 is interposed between first and second crura 90A–B. In one embodiment, ends of bi-element transducer 125 are shaped to receive first and second crura 90A–B such that bi-element transducer 125 fits snugly in place, as illustrated generally FIG. 9B. In another embodiment, bi-element transducer 125 is secured in place by any attachment technique (not shown), such as biocompatible adhesive, a mechanical fastener, or a support bracket. Rod 130 is coupled between bi-element transducer 125 and stapes 50, such as at footplate 95.

Bi-element transducer 125 includes first and second plates 125A–B, which are bonded together such that they amplify a piezoelectric action in a direction approximately normal to the bonding plane. Electronics unit 111 provides an electrical input signal through lead wires 112 and 113 respectively received at connection points 116 and 117 on respective first and second plates 125A–B of bi-element transducer 125. Vibrations of bi-element transducer 125 are coupled to a footplate 95 portion of stapes 50 by rod 130, and in turn coupled to an oval window 55 portion of cochlea 60.

Figure 10:
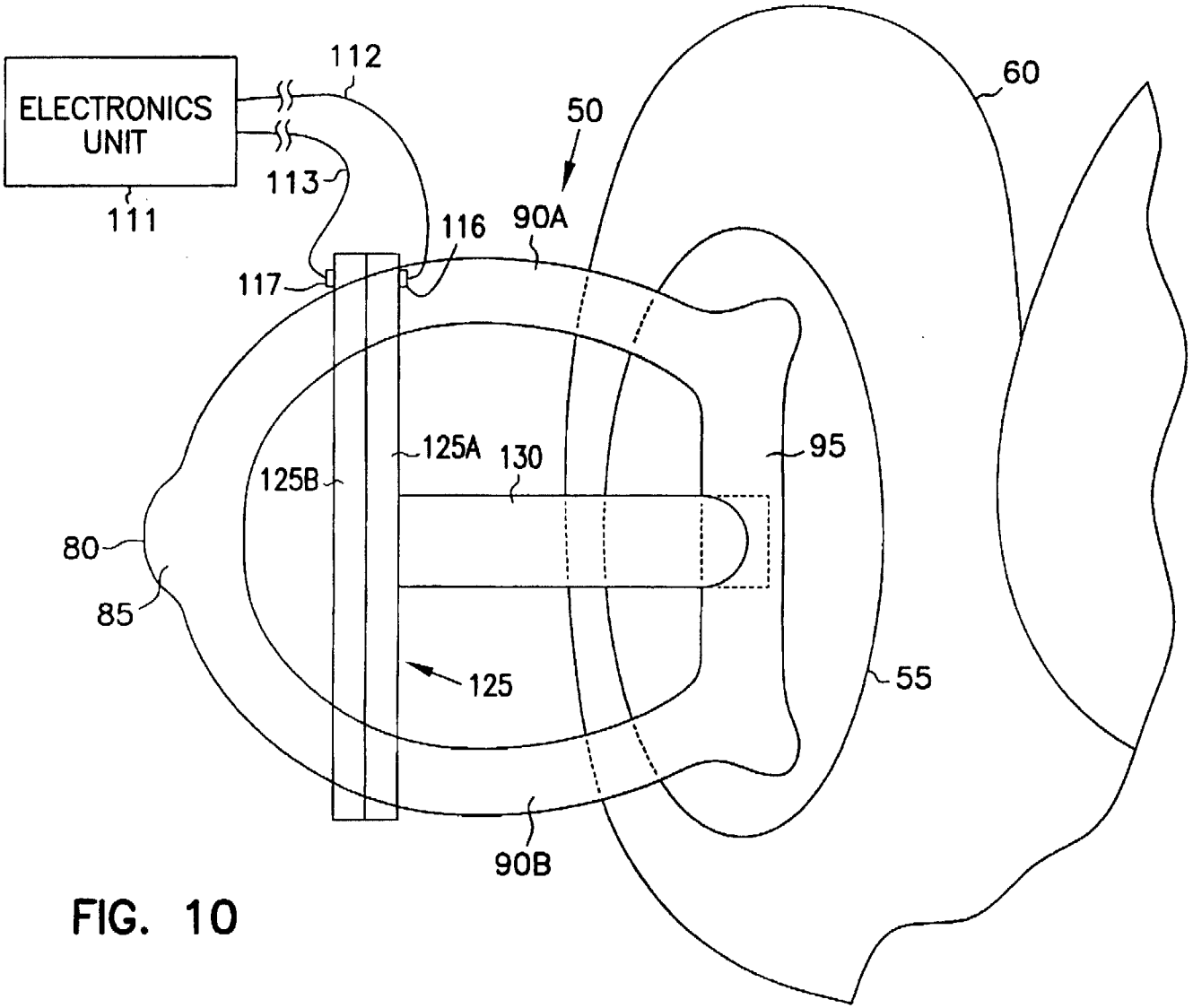
FIG. 10 illustrates a vibrator including a bi-element transducer and a rod interposed between the bi-element transducer and an oval window portion of the cochlea.

FIG. 10 illustrates generally another embodiment of the invention in which rod 130 couples mechanical vibrations directly to oval window 55 portion of cochlea 60 through a hole in footplate 95 portion of stapes 50.

Figure 11:
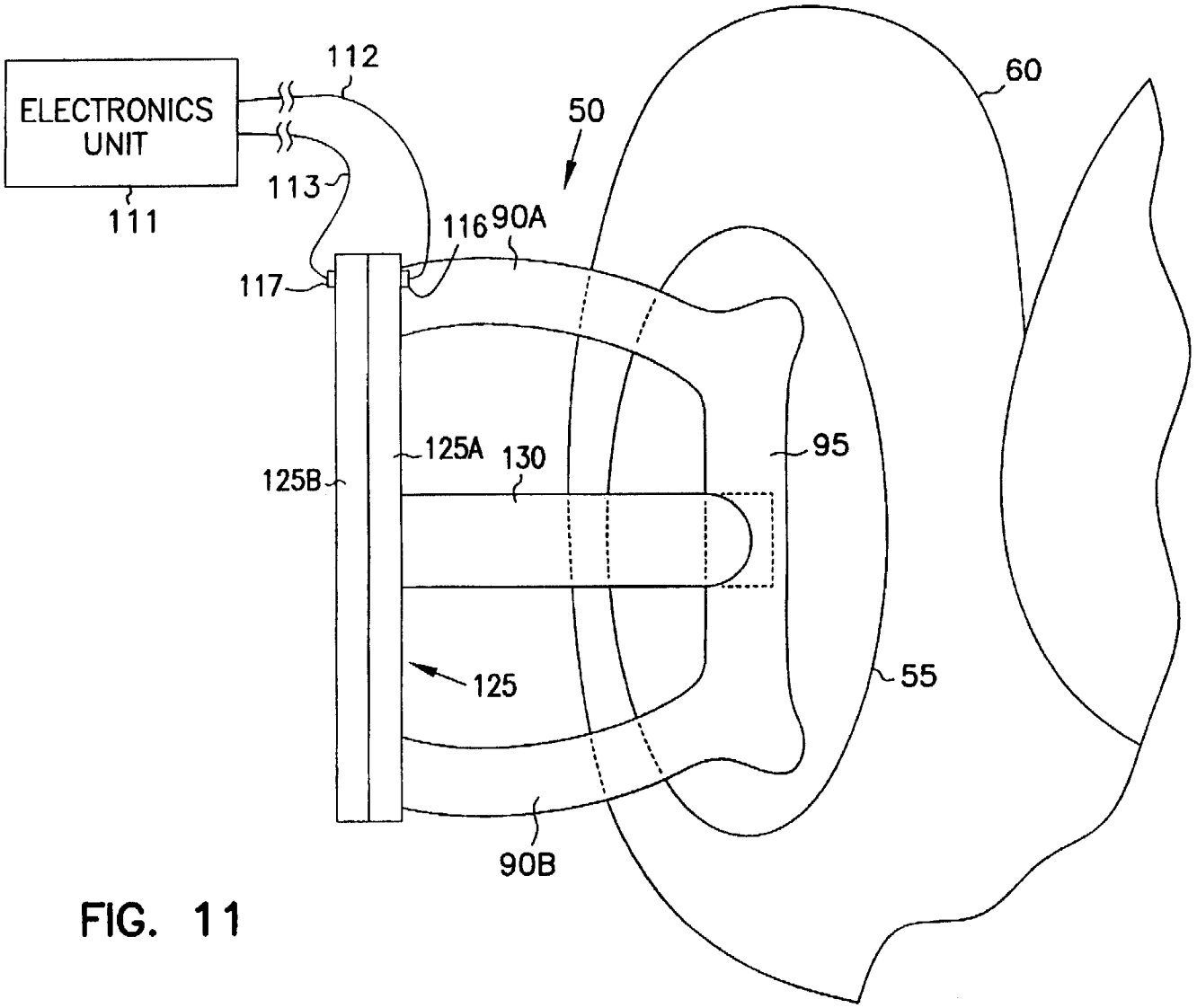
FIG. 11 illustrates a vibrator including a bi-element transducer attached to a stapes having head and neck portions removed, and coupled to an oval window portion of the cochlea by a rod.

FIG. 11 illustrates generally another embodiment of the invention illustrated in FIG. 10, in which rod 130 couples mechanical vibrations directly to oval window 55 portion of cochlea 60 through a hole in footplate 95 portion of stapes 50. In this embodiment, head 80 and neck 85 portions of stapes 50 are removed, and bi-element transducer 125 is interposed between and attached to first and second crura 90A–B by any attachment technique, such as biocompatible adhesive, a mechanical fastener, or a support bracket.

FIGS. 10–11 are particularly advantageous to patients who have undergone stapendectomies and received ossicular prosthesis. In one such stapendectomy procedure, an ossicular prosthesis is pushed through a hole in footplate 95 portion of stapes 50 and also through the oval window 55. The ossicular prosthesis contacts the perilymph of cochlea 60 until a new membrane naturally forms around the ossicular prosthesis. In such cases, rod 130 may comprise at least a portion of the ossicular prosthesis itself, as described above.

In the above described embodiments, a highly piezoelectric film such as a polarized fluoropolymer, e.g. polyvinylidene fluoride (PVDF) could be used instead of ceramic piezoelectric transducer 110 or ceramic piezoelectric bi-element transducer 125. For example, a PVDF film such as that sold under the trademark "Kynar" by AMP, Inc., of Harrisburg, Pa., may be used.

The invention is useful in a P-MEI hearing aid system, and particularly useful in a T-MEI hearing aid system. In one such T-MEI system, an input transducer is associated with the malleus 40, transducing mechanical energy into an electrical signal, which is amplified. A resulting electrical signal in the audio frequency range is provided to vibrator 100 which mechanically vibrates stapes 50 as described above. The signal provided to vibrator 100 could also be obtained from an external microphone.

Thus, the invention provides an electromechanical stapes vibrator having a small size which is well adapted to implantation in the middle ear. The invention permits use of a piezoelectric output transducer without requiring attachment to a temporal bone within the middle ear. The low power consumption of the piezoelectric element is particularly advantageous in a T-MEI hearing aid system in which a limited longevity implanted battery provides power to the system.

We claim:

1. A vibrator for disposing within a middle ear, the vibrator comprising an electromechanical transducer proportioned for vibrating an auditory element in response to an electrical input signal, in which the transducer is adapted to be mechanically coupled to at least a first and a second portion of the stapes.

2. The vibrator of claim 1, in which the auditory element comprises the stapes.

3. The vibrator of claim 1, in which the auditory element comprises an oval window.

4. The vibrator of claim 1, in which the first and second portions of the stapes comprise a footplate and a neck respectively.

5. The vibrator of claim 1, in which the transducer comprises a ceramic piezoelectric single element transducer.

6. The vibrator of claim 1, in which the transducer comprises a plurality of ceramic piezoelectric single element transducers.

7. The vibrator of claim 1, in which the transducer comprises a ceramic piezoelectric bi-element transducer.

8. The vibrator of claim 1, in which the transducer comprises a piezoelectric film.

9. The vibrator of claim 1, in which the transducer has a dynamically varying physical dimension in response to the electrical input signal.

10. The vibrator of claim 9, in which the dynamically varying physical dimension of the transducer comprises a dynamically varying transducer length in a longitudinal direction between the first and second portions of the stapes.

11. The vibrator of claim 10, in which the dynamically varying transducer length deforms at least a portion of the stapes.

12. The vibrator of claim 11, in which the first and second portions of the stapes comprise a footplate and a neck respectively, and the footplate mechanically couples a force to an oval window of a cochlea in response to the dynamically varying transducer length.

13. The vibrator of claim 1, further comprising a spacer proportioned for fitting the transducer between the first and second portions of the stapes, in which the spacer is coupled to the transducer.

14. The vibrator of claim 13, in which the spacer is adapted to be interposed between the transducer and one of the first and second portions of the stapes.

15. The vibrator of claim 13, in which the transducer comprises first and second portions and the spacer is interposed between the first and second portions of the transducer.

16. The vibrator of claim 15, in which the first and second transducer portions are electrically configured in parallel.

17. The vibrator of claim 15, in which the first and second transducer portions are electrically configured in anti-parallel.

18. The vibrator of claim 17, in which the spacer has inertial mass which resists vibrations of the first and second portions of the transducer to mechanically couple the vibrations to the first and second portions of the stapes.

19. The vibrator of claim 1, further comprising a rod mechanically coupled to the transducer and adapted to be couple to a footplate portion of the stapes.

20. The vibrator of claim 1, further comprising a rod mechanically coupled to the transducer and adapted to be coupled to an oval window.

21. The vibrator of claim 20, in which the rod comprises an ossicular prosthesis for contacting with a perilymph of the cochlea.

22. The vibrator of claim 1 wherein the transducer is interposed between at least a first and a second portion of the stapes.

23. A method of improving hearing comprising:

coupling an electromechanical transducer to at least first and second portions of a stapes in a middle ear; and applying an electrical input signal to the transducer to vary a physical dimension of the transducer and thereby vibrate an auditory element.

24. The method of claim 23, in which first and second portions of the stapes comprise a footplate and a neck respectively.

25. The method of claim 23, in which first and second portions of the stapes comprise first and second crura respectively.

26. The method of claim 23, in which the auditory element comprises the stapes.

27. The method of claim 23, in which the auditory element comprises an oval window.

28. The method of claim 23, in which the physical dimension varied is a transducer length in a longitudinal direction between the first and second portions of the stapes.

29. The method of claim 23, in which vibrating the auditory element comprises transmitting a force to an oval window of a cochlea.

30. The method of claim 23, in which vibrating the auditory element comprises transmitting a force to a perilymph of the cochlea.

31. The method of claim 23, further comprising coupling to the transducer a spacer proportioned for fitting the transducer between the first and second portions of the stapes.

32. The method of claim 31, in which coupling to the transducer a spacer comprises interposing the spacer between the transducer and one of the first and second portions of the stapes.

33. The method of claim 31, in which the electromechanical transducer comprises first and second portions, and in which coupling to the transducer a spacer comprises interposing the spacer between the first and second portions of the transducer.

34. The method of claim 33, in which applying an electrical input signal comprises applying the signal in parallel to the first and second transducer portions.

35. The method of claim 33, in which applying an electrical input signal comprises applying the signal in anti-parallel to the first and second transducer portions.

36. The method of claim 35, in which the spacer has inertial mass which resists vibrations of the first and second portions of the transducer to mechanically couple the vibrations to the first and second portions of the stapes.

37. The method of claim 23, in which the electromechanical transducer comprises at least one piezoelectric element.

38. The method of claim 23 wherein the step of coupling an electromechanical transducer to at least first and second portions of a stapes further comprises the step of interposing the electromechanical transducer between at least first and second portions of the stapes.

39. An implantable hearing system comprising a vibrator adapted to be disposed within the middle ear, in which the vibrator includes an electromechanical transducer proportioned for vibrating an auditory element in response to an electrical input signal, and the transducer is adapted to be mechanically coupled to first and second portions of a stapes; and an electronics unit coupled to the transducer for providing an electrical input signal to the transducer.

40. The system of claim 39, further comprising a rod mechanically coupled to the transducer and adapted to be coupled to a footplate portion of the stapes.

41. The system of claim 39, further comprising a rod mechanically coupled to the transducer and adapted to be coupled to an oval window.

42. The system of claim 41, in which the rod comprises an ossicular prosthesis for contacting with a perilymph of the cochlea.

43. The system of claim 39, further comprising a spacer proportioned for fitting the transducer between the first and second portions of the stapes, in which the spacer is coupled to the transducer.

44. The system of claim 43, in which the spacer is adapted to be interposed between the transducer and one of the first and second portions of the stapes.

45. The system of claim 43, in which the transducer comprises first and second portions and the spacer is interposed between the first and second portions of the transducer.

46. The system of claim 45, in which the first and second transducer portions are electrically configured in parallel.

47. The system of claim 45, in which the first and second transducer portions are electrically configured in anti-parallel.

48. The system of claim 47, in which the spacer has inertial mass which resists vibrations of the first and second portions of the transducer to mechanically couple the vibrations to the first and second portions of the stapes.

49. The system of claim 39, in which the first and second portions of the stapes comprise a footplate and a neck respectively.

50. The system of claim 49, in which the dynamically varying transducer length mechanically couples a force to an oval window of a cochlea.

51. The system of claim 49, in which the transducer has a dynamically varying physical dimension in response to the electrical input signal.

52. The system of claim 51, in which the dynamically varying physical dimension of the transducer comprises a dynamically varying transducer length in a longitudinal direction between the first and second portions of the stapes.

53. The system of claim 52, in which the dynamically varying transducer length deforms at least a portion of the stapes.

54. The system of claim 39 wherein the transducer is interposed between at least a first and a second portion of the stapes.

* * * * *